US008959697B2

(12) United States Patent
Yu

(10) Patent No.: US 8,959,697 B2
(45) Date of Patent: Feb. 24, 2015

(54) MOP WITH SPINNING DEVICE

(76) Inventor: Tsung-Mou Yu, Panchiao (TW)

( * ) Notice: Subject to any disclaimer, the term of this patent is extended or adjusted under 35 U.S.C. 154(b) by 401 days.

(21) Appl. No.: 13/502,512

(22) PCT Filed: Jan. 13, 2011

(86) PCT No.: PCT/CN2011/000051
§ 371 (c)(1),
(2), (4) Date: Apr. 17, 2012

(87) PCT Pub. No.: WO2012/051780
PCT Pub. Date: Apr. 26, 2012

(65) Prior Publication Data

US 2012/0233794 A1 Sep. 20, 2012

(30) Foreign Application Priority Data

Oct. 20, 2010 (CN) ..... 2010 2 0568450 U

(51) Int. Cl.
*A47L 13/20* (2006.01)
*A47L 13/14* (2006.01)
*B25G 1/04* (2006.01)

(52) U.S. Cl.
CPC .. *A47L 13/14* (2013.01); *B25G 1/04* (2013.01)
USPC ..... 15/119.1

(58) Field of Classification Search
USPC ..... 15/119.1, 120.1, 120.2, 97.1, 228, 98
See application file for complete search history.

(56) References Cited

U.S. PATENT DOCUMENTS

| | | | | |
|---|---|---|---|---|
| 6,125,494 | A | 10/2000 | Morad | |
| 6,732,396 | B2 | 5/2004 | Laux | |
| 8,220,101 | B2 * | 7/2012 | Chen | 15/119.1 |
| 2003/0208867 | A1 | 11/2003 | Laux | |
| 2009/0307856 | A1 * | 12/2009 | Fischer et al. | 15/97.1 |
| 2010/0287722 | A1 * | 11/2010 | Yu | 15/228 |
| 2011/0225752 | A1 * | 9/2011 | Yu | 15/119.1 |

FOREIGN PATENT DOCUMENTS

| | | |
|---|---|---|
| CN | 201481325 U | 5/2010 |
| CN | 101744595 A | 6/2010 |
| CN | 101810456 A | 8/2010 |
| TW | 201028123 | 8/2010 |

* cited by examiner

*Primary Examiner* — Robert Scruggs
(74) *Attorney, Agent, or Firm* — Muncy, Geissler, Olds & Lowe, P.C.

(57) ABSTRACT

A mop includes a handle connected to one end of a first rod. The other end of the first rod is connected to a second rod. A driving unit includes a spiral member disposed in one end of the second rod. A clutch unit is disposed in the first rod. A mopping unit is pivotably connected to the other end of the second rod. The clutch unit includes a sleeve disposed in the first rod and having a crown teeth defined in a lower end thereof. A bearing is connected to an opening of the sleeve, which is rotatable relative to the bearing. A crown gear is disposed in the sleeve and separably engaged with the crown teeth. A spring is disposed between the crown gear and the bearing. The spiral rod inserts through the bearing and the spring and is fixed to the crown gear.

2 Claims, 7 Drawing Sheets

MOP WITH SPINNING DEVICE

BACKGROUND OF THE INVENTION

1. Field of the Invention

The present invention generally relates to a mop, and more particular to a mop with a spinning device, which includes a clutch unit connected with a driving unit.

2. The Prior Arts

In order to easily remove water from mops, multiple mops with a spinning device are presented in the market; thereby the user can operate the spinning device to let the disk spin to remove the water from the mop.

Among the conventional mops with a spinning device, the mop having a press rod is most popular and comprises a spiral member having a spiral hole defined through the spiral member. A spiral rod inserts through the spiral hole, and a unidirectional bearing is sleeved with the spiral rod. A retractable rod has a first end connected to a mop head, and a second end tightly fitted to a first end of the spiral member. The press rod is sleeved around the spiral rod and has a first end slidably connected to the spiral member and an outside of the retractable rod. A second end of the press rod is connected to a second end of the spiral rod.

When the mop is put into a rotatable bucket and the press rod is operated downward, the retractable rod is retracted into the pressing rod to drive the spiral member to spin and move upward along the spiral rod, so as to simultaneously drive the retractable rod, the mop head and the bucket to rotate to remove the water from the mop by a centrifugal force during rotation.

The above-mentioned mops have the unidirectional bearing to be mounted to the second end of the spiral rod. When the press rod is applied a downward force, the retractable rod is retracted into the press rod. Due to the action of the unidirectional bearing, the spiral rod does not rotate; thereby the spiral member moves upward along the spiral rod to drive the retractable rod and the mop head to rotate. The centrifugal force removes the water from the mop during rotation of the mop head.

The above-mentioned mops have a different structure from the prior mops that use a foot stepping mechanism to rotate the mop head. The above-mentioned mops drive the mop head and the rotatable bucket by hand instead of by foot-stepping to rotate for removing the water therefrom; thereby dramatically reducing the manufacturing cost.

However, the above-mentioned mops comprise the spiral member, the spiral rod and the unidirectional bearing. The spiral rod and the unidirectional bearing repeatedly rotate without any buffer arrangement, so that there has a wear problem between the spiral member, the spiral rod and the unidirectional bearing, which affects the operation of the mops and reduces the lifetime thereof.

SUMMARY OF THE INVENTION

A primary objective of the present invention is to provide a mop with a spinning device which has a clutch unit to engage and disengage a driving unit and driven units so as to reduce wear therebetween and prolong the lifetime thereof In order to achieve the above objective, a mop according to the present invention comprises a handle connected to a first end of a first rod. A second end of the first rod is connected to a second rod, which is retractable relative to the first rod. A driving unit comprises a spiral rod and a spiral member which has a spiral hole defined therethrough. The spiral member is disposed in the second rod, and the spiral rod inserts through the spiral hole of the spiral member. The spiral rod can move and spin relative to the spiral hole of the spiral member. A clutch unit comprises a sleeve disposed in the first rod. The sleeve has a unidirectional crown teeth defined in a lower end of the sleeve. A bearing is connected to an opening of the sleeve, and the sleeve is rotatable relative to the bearing. A unidirectional crown gear is disposed in the sleeve and separately engaged with the unidirectional crown teeth in the sleeve. A spring is disposed between the unidirectional crown gear and the bearing. The spiral rod of the driving unit has an end thereof extending through the bearing and the spring and then fixed to the unidirectional crown gear. A mopping unit is pivotably connected to the second rod.

With the above technical solutions, when the users want to remove the water contained in the mopping unit, a disk of the mop is put into a basket in a bucket and the hand is pushed downward which moves the first rod and the clutch unit downward. The unidirectional crown teeth of the sleeve of the clutch unit is engaged with the unidirectional crown gear. The unidirectional crown gear cannot rotate reversely because it is engaged with the unidirectional crown teeth. The clutch unit pushes the spiral rod to extend through the spiral member, and the spiral member spins and moves along the spiral rod. The movement of the spiral member drives the second rod, the pivotal unit and the mopping unit to rotate. When the mopping unit spins, the water contained in the mopping unit is removed therefrom and the removed water is collected in the bucket. The mopping unit is then ready for next use.

When the unidirectional crown teeth of the sleeve of the clutch unit are engaged with the unidirectional crown gear. The spring between the unidirectional crown gear and the bearing absorbs the impact therebetween so as to reduce wear due to friction, and then reduce noise and vibration.

The present invention improves the shortcomings of Taiwanese patent application No. 98102868, titled "a mop with a spinning device", and has a simpler structure and a lower manufacturing cost.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
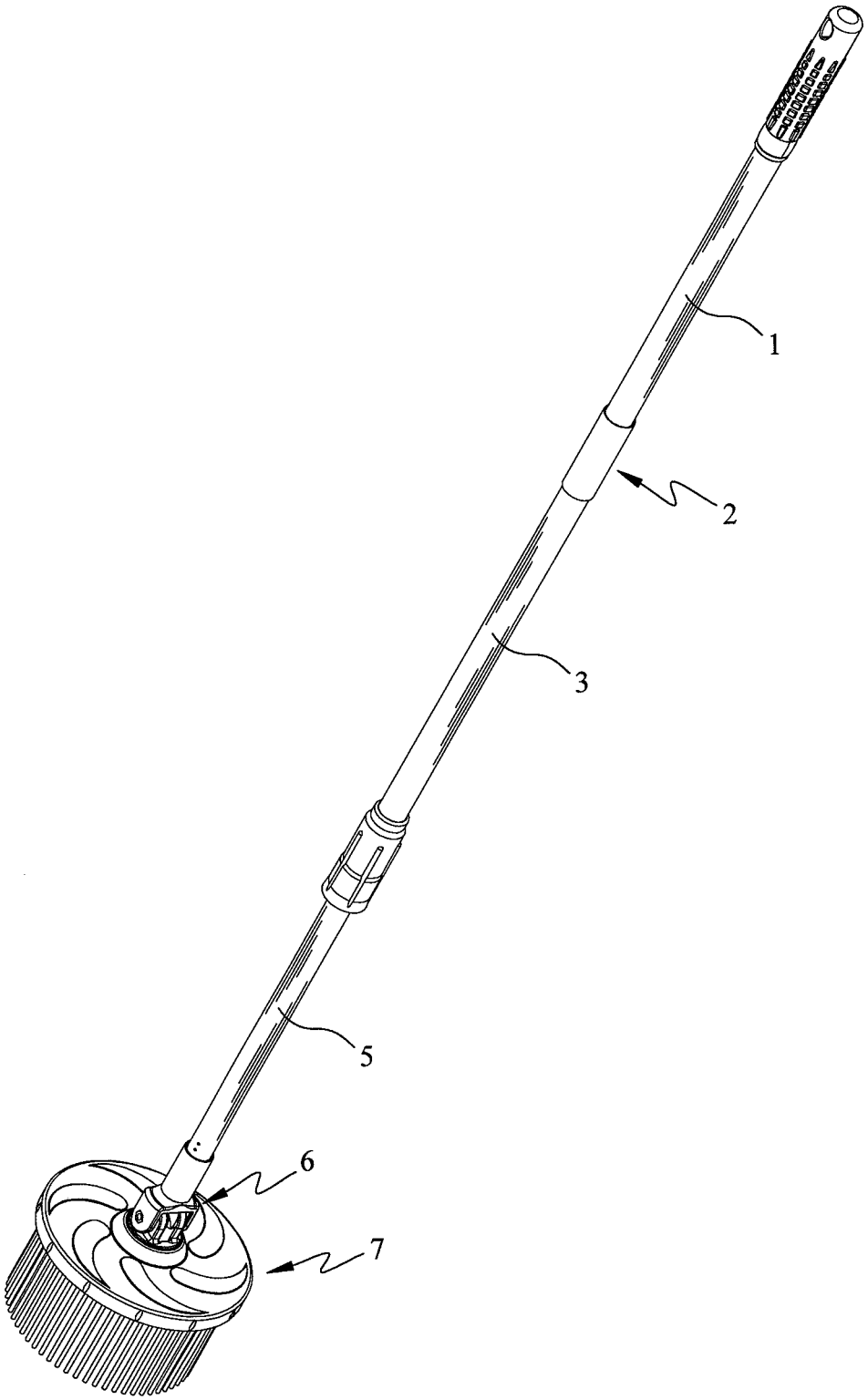
FIG. 1 is a perspective view of a mop according to the present invention.
Figure 2:
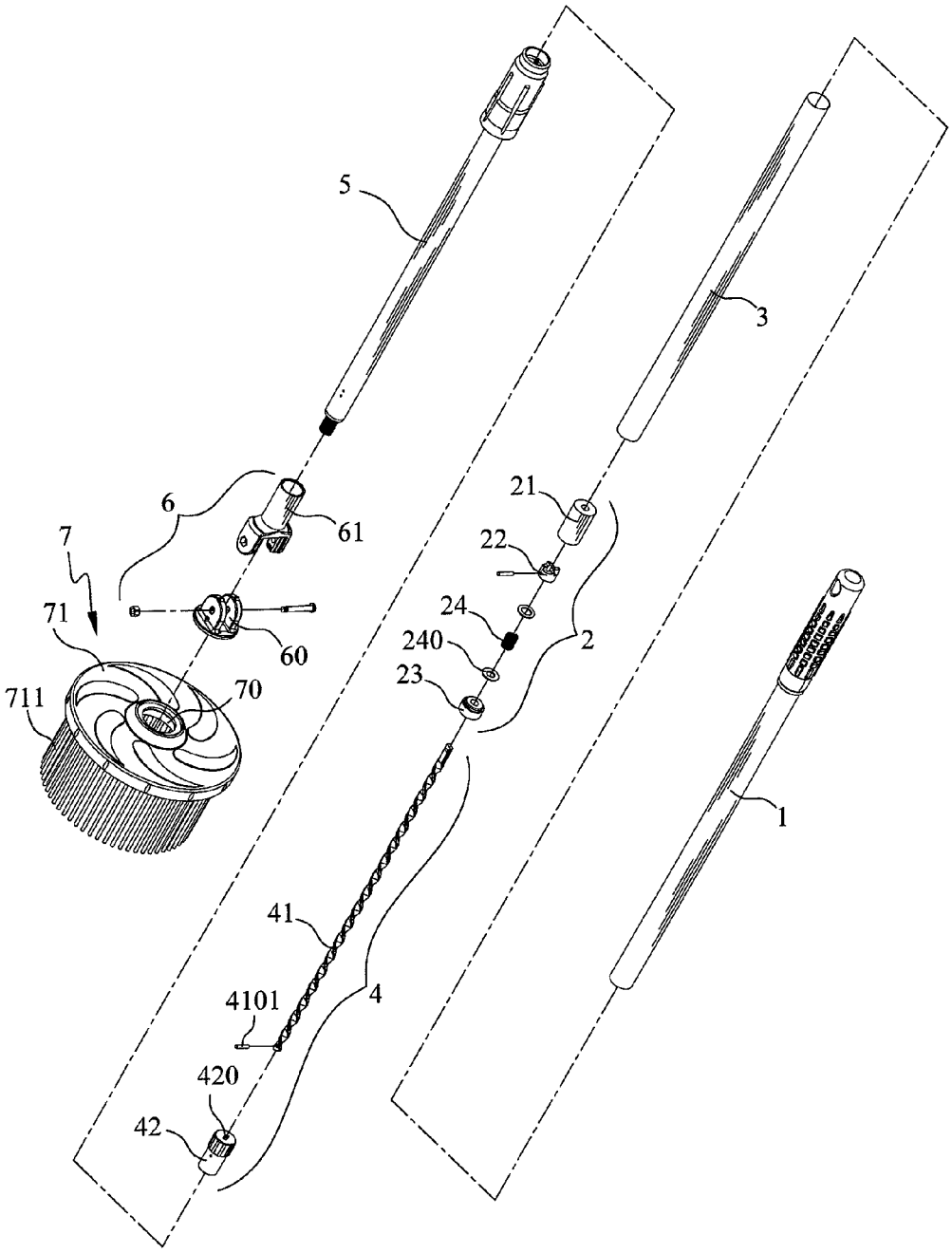
FIG. 2 is an exploded perspective view of the mop according to the present invention.

With reference to the drawings and in particular to FIGS. 1 and 2, a mop in accordance with the present invention comprises a handle 1 connected to a first end of a first rod 3. A second end of the first rod 3 is connected to the second rod 5, which is retractable relative to the first rod 3.

A driving unit 4 comprises a spiral rod 41 and a spiral member 42 which has a spiral hole 420 defined therethrough. The spiral member 42 is disposed in the second rod 5. The spiral rod 41 inserts through the spiral hole 420 of the spiral member 42, so that the spiral rod 41 can move relative to the spiral hole 420 of the spiral member 42. The spiral rod 41 has a restriction end 410 which has a pin 4101 extending therethrough, so as to stop the spiral member 42 from being disengaged from the spiral rod 41 by the pin 4101.

Figure 3:
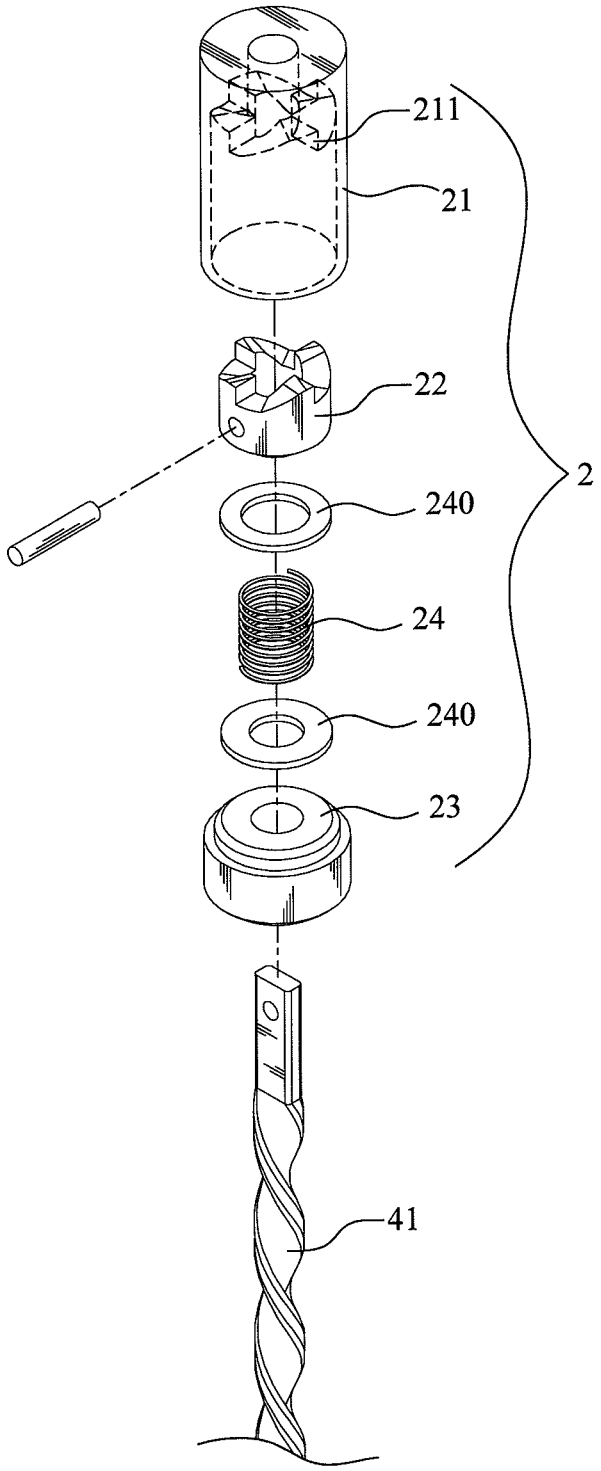
FIG. 3 is an exploded view of a clutch unit of the mop according to the present invention.
Figure 4:
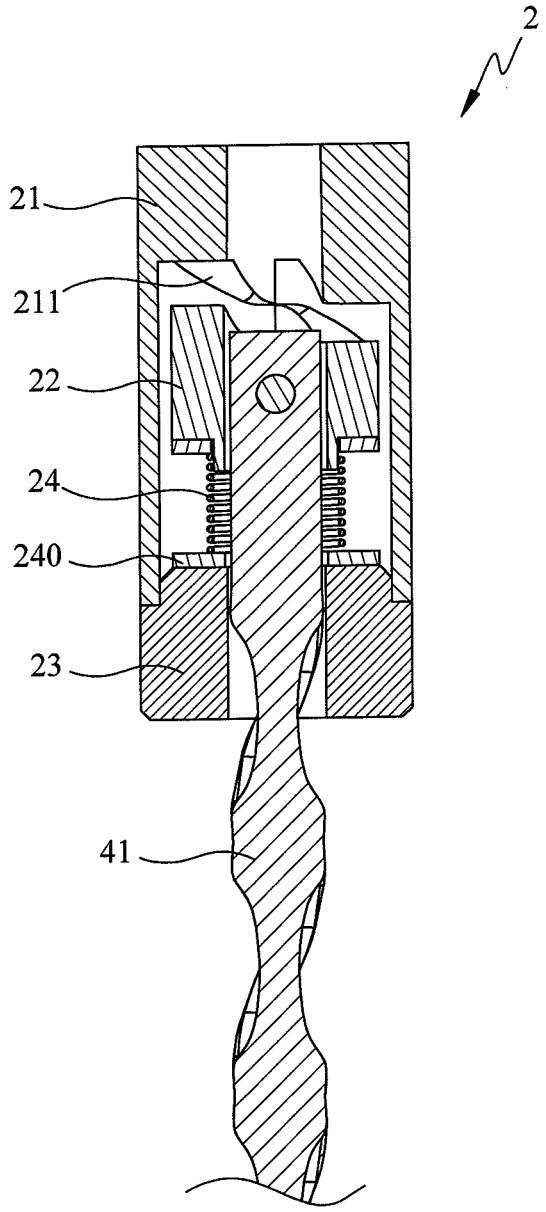
FIG. 4 is a cross sectional view showing the clutch unit of the present invention is in a disengaged state.
Figure 5:
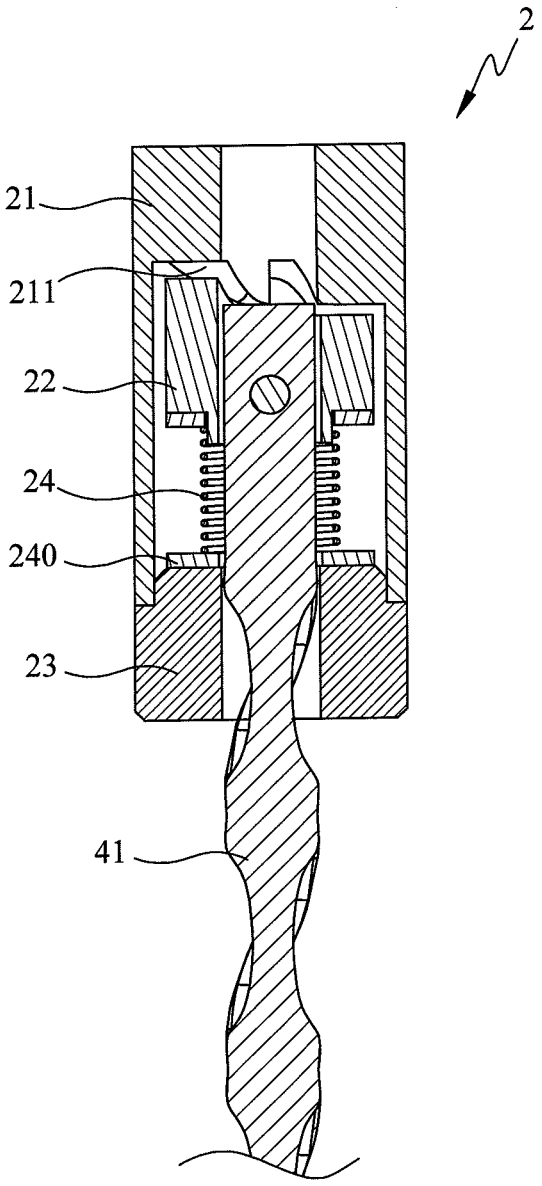
FIG. 5 is a cross sectional view showing the clutch unit of the present invention is in an engaged state.

Referring to FIGS. 3 to 5, a clutch unit 2 comprises a sleeve 21 disposed in the first rod 3. The sleeve 21 has a unidirectional crown teeth 211 defined in a lower end of the sleeve 21. A bearing 23 is connected to an opening of the sleeve 21 and the sleeve 21 is rotatable relative to the bearing 23. A unidirectional crown gear 22 is disposed in the sleeve 21 and separably engaged with the unidirectional crown teeth 211 in the sleeve 21. A spring 24 is disposed between the unidirectional crown gear 22 and the bearing 23. Two washers 240 are respectively connected to two ends of the spring 24. The end of the spiral rod 41 of the driving unit 4, which is located in opposite to the restriction end 410 of the spiral rod 41, extends through the bearing 23, the washers 240 and the spring 24, and is fixed to the unidirectional crown gear 22 by a fixing pin.

The unidirectional crown teeth 211 and the unidirectional crown gear 22 of the clutch unit 2 has a same rotational direction as the spiral rod 41 of the driving unit 4.

A mopping unit 7 comprises a disk 71 to which a mopping member 711 is connected. The mopping member 711 is composed of multiple fabric strips and the disk 71 has a connection hole 70. The disk 71 of the mopping unit 7 is pivotably connected to the second rod 5 by a pivotal unit 6. The pivotal unit 6 has a pivotal member 61 and a connection base 60 pivotally connected to the pivotal member 61. The pivotal member 61 is connected to the second rod 5. The connection base 60 is sleeveably connected to the connection hole 70 of the disk 71, so that the users can easily assemble and disassemble the disk 71.

The first rod 3, the second rod 5, the driving unit 4, the clutch unit 2, the pivotal unit 6 and the mopping unit 7 are axially connected to each other.

Figure 6:
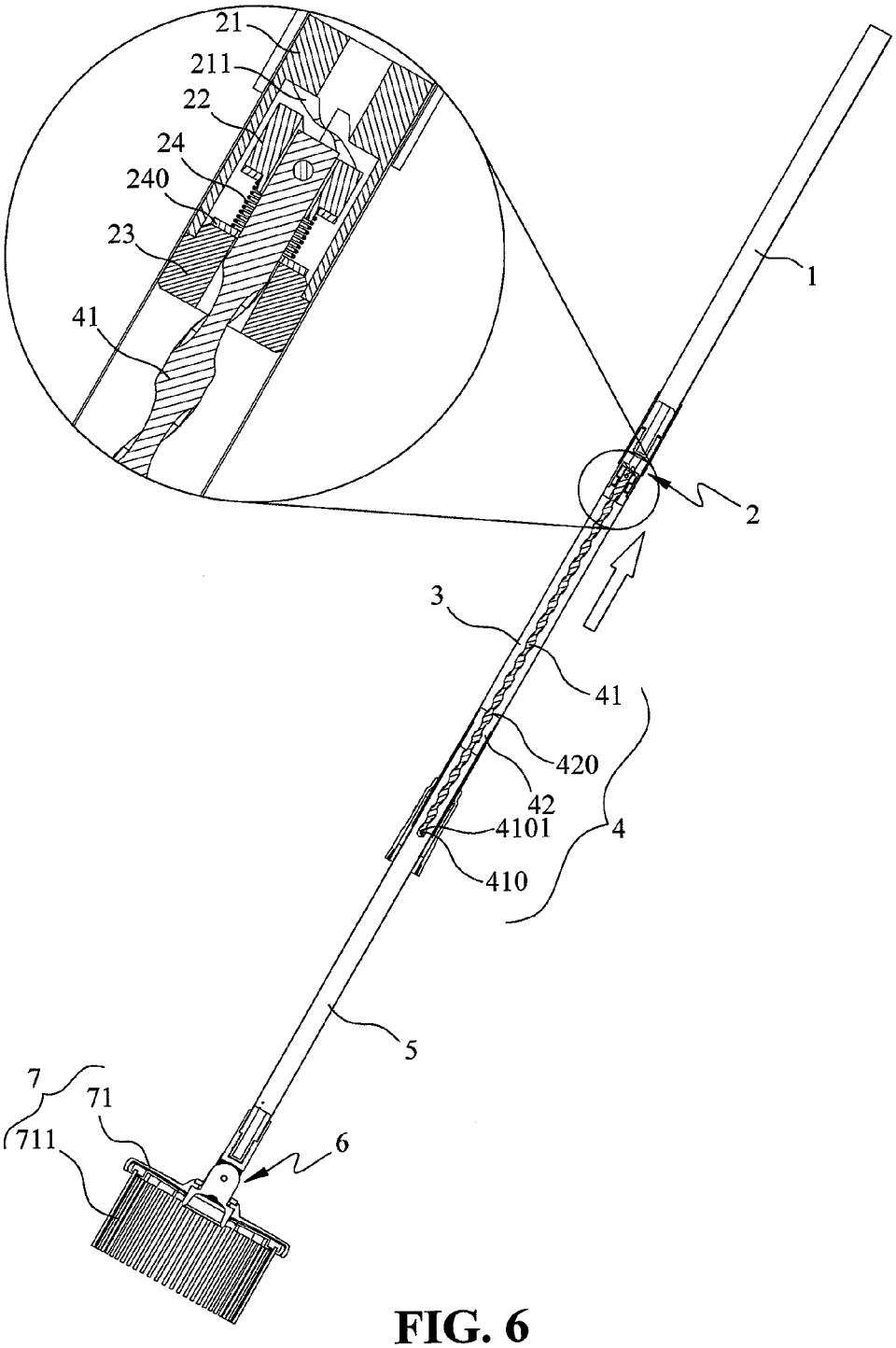
FIG. 6 is a cross sectional view of the mop according to the present invention.
Figure 7:
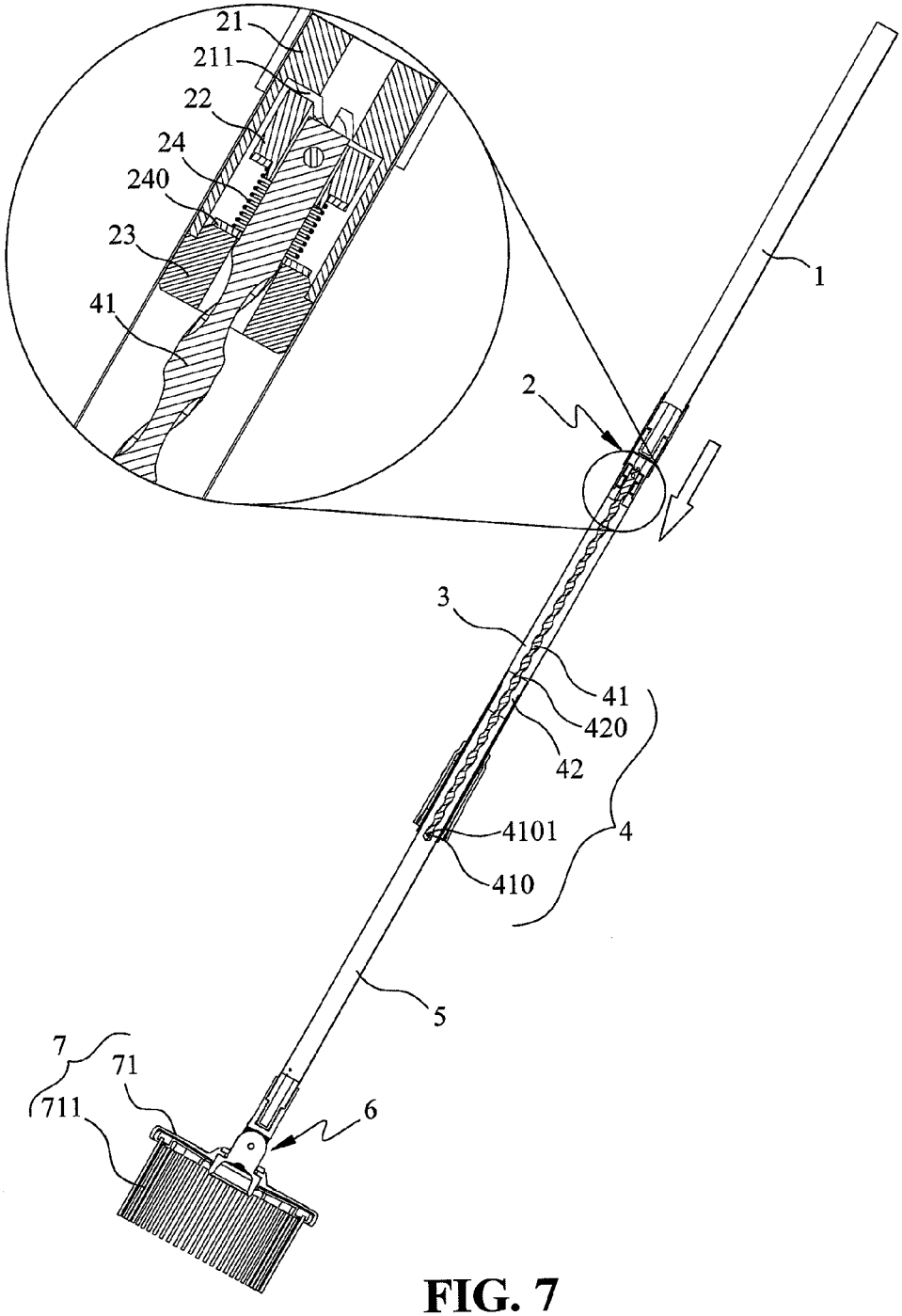
FIG. 7 shows another cross sectional view of the mop according to the present invention.

As shown in FIGS. 6 and 7, when the users want to remove the water contained in the mopping unit 7, the disk 71 of the mop is put into a basket in a bucket (the basket is rotatable relative to the bucket) and the hand 1 is pushed downward which moves the first rod 3 and the clutch unit 2 downward. The unidirectional crown teeth 211 of the sleeve 21 of the clutch unit 2 is engaged with the unidirectional crown gear 22. The unidirectional crown gear 22 cannot rotate reversely because it is engaged with the unidirectional crown teeth 221. The clutch unit 2 pushes the spiral rod 41 to extend through the spiral member 42, and the spiral member 42 spins and moves along the spiral rod 41. The movement of the spiral member 42 drives the second rod 5, the pivotal unit 6 and the mopping unit 7 to rotate.

When the unidirectional crown teeth 211 of the sleeve 21 of the clutch unit 2 are engaged with the unidirectional crown gear 22, the spring 24 between the unidirectional crown gear 22 and the bearing 23 absorbs the impact therebetween so as to reduce wear due to friction, and then reduce noise and vibration.

On the contrary, when the users raise the handle 1 upward, the clutch unit 2 is raised upward as well and the unidirectional crown teeth 211 are disengaged from the unidirectional crown gear 22, so that the unidirectional crown gear 22 rotates in a reverse direction relative to the rotational direction of the spiral rod 4 and the spiral member 42, which does not drive the second rod 5 and the mopping unit 7 so as to ensure that the unidirectional crown gear 22 rotates in the same direction.

When the mopping unit 7 is spinning, the water contained in the mopping member 711 is removed therefrom and the water is collected in the bucket. The mopping unit 7 is then ready for next use.

Due to a novel design of the clutch unit 2, the friction between parts of the present invention can be reduced and the lifetime of the mop of the present invention is prolonged. The spring 24 between the unidirectional crown gear 22 and the bearing 23 absorbs the impact therebetween. Due to the action of the spring, the users can feel less vibration from the handle 1, operation comfortable, and less noise generated from parts of the present invention.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A mop comprising:

a handle connected to a first end of a first rod, a second end of the first rod connected to a second rod, which is retractable relative to the first rod;

a driving unit comprising a spiral rod and a spiral member which has a spiral hole defined therethrough, the spiral member disposed in the second rod, the spiral rod inserting through the spiral hole of the spiral member, the spiral rod being able to spin and move relative to the spiral hole of the spiral member;

a clutch unit comprising a sleeve connected to the first rod at an end of the first rod, the sleeve having a unidirectional crown teeth defined in a lower end of the sleeve, a bearing connected to an opening of the sleeve and the sleeve being rotatable relative to the bearing, a unidirectional crown gear disposed in the sleeve and separably engaged with the unidirectional crown teeth in the sleeve, a spring disposed between the unidirectional crown gear and the bearing, the spiral rod of the driving unit having an end thereof extending through the bearing and the spring and fixed to the unidirectional crown gear; and a mopping unit pivotably connected to the second rod.

2. The mop as claimed in claim 1, wherein the spiral rod has a restriction end which stops the spiral member from being disengaged from the spiral rod.

* * * * *